US006364383B1

(12) United States Patent
Shen

(10) Patent No.: US 6,364,383 B1
(45) Date of Patent: Apr. 2, 2002

(54) EASY-TO-INSTALL DOOR LOCK WITH BURGLAR-PROOF EFFECT FOR OUTSIDE ROSE ASSEMBLY

(76) Inventor: Mu-Lin Shen, No. 32, Lane 76, Fu-An Road, Sec. 5, Tainan (TW)

( * ) Notice: Subject to any disclaimer, the term of this patent is extended or adjusted under 35 U.S.C. 154(b) by 0 days.

(21) Appl. No.: 09/654,277

(22) Filed: Sep. 1, 2000

(51) Int. Cl.[7] ..... E05B 15/02
(52) U.S. Cl. ..... 292/357; 292/336.3; 292/347
(58) Field of Search ..... 292/357, 336.3, 292/347

(56) References Cited

U.S. PATENT DOCUMENTS 4,921,289 A * 5/1990 Shen ..... 292/357 X
5,265,924 A * 11/1993 Kim ..... 292/336.3
5,732,578 A * 3/1998 Kang ..... 292/357 X
6,302,457 B1 * 10/2001 Shen ..... 292/327 X

* cited by examiner

*Primary Examiner*—Teri Pham Luu
(74) *Attorney, Agent, or Firm*—Alan Kamrath; Rider, Bennett, Egan & Arundel, LLP

(57) ABSTRACT

A door lock includes a main body having a transmission assembly and a positioning assembly. The positioning assembly includes an inside seat and an outside seat. An inside rose liner is mounted around the inside seat. An inside rose is mounted around the inside rose liner. An anti-torque ring is mounted around the outside seat and includes two positioning posts projecting therefrom. An adjusting sleeve includes an inner threading that is engaged with the outer threading of the outside seat. A first end of the adjusting sleeve includes two diametrically opposed cutouts, thereby defining two sector wings each having two end faces. Each end face defines an end of an associated cutout. The sector wings of the adjusting sleeve is mounted into a hole of the anti-torque ring with each end face bearing against an associated end of the associated flat section of the anti-torque ring. An outside rose is securely mounted around a second end of the adjusting sleeve to rotate move therewith. Rotation of the outside rose causes longitudinal movement of the outside rose and the adjusting sleeve relative to the outside seat to suit a thickness of a door to which the door lock is mounted.

6 Claims, 5 Drawing Sheets

EASY-TO-INSTALL DOOR LOCK WITH BURGLAR-PROOF EFFECT FOR OUTSIDE ROSE ASSEMBLY

BACKGROUND OF THE INVENTION

1. Field of the Invention

The present invention relates to a door lock that can be installed easily and that provides a burglarproof effect for the outside rose assembly.

2. Description of the Related Art

U.S. Pat. No. 4,921,289 to Shen issued on May 1, 1990 discloses a cylindrical lever type lock structure for handicapped people and U.S. Pat. No. 4,604,879 to Neary et al. issued on Aug. 12, 1986 discloses a cylindrical lock. A common drawbacks of the locks disclosed in these two patents is that the cover ring 10'/outside nut 24 has a loose engagement with the outside escutcheon due to poor surface contact relationship between an outer periphery of the former and an inner periphery defining a central hole of the latter. As a result, when the outside escutcheon is rotated to turn the cover ring 10'/outside nut 24 for translating the cover ring 10'/outside nut 24 along a longitudinal direction relative to the spindle housing 18/outside hub 19 for adjusting the longitudinal position of the cover ring 10'/outside nut 24 in response to the door thickness, the outside escutcheon rotates freely and thus fails to achieve the required adjusting function. A solution to solve this problem is to turn the cover ring 10'/outside nut 24 directly, yet the human fingers are too big for the exposed portion of the cover ring 10'/outside nut 24 such that turning of the cover ring 10'/outside nut 24 is awkward and difficult to proceed.

Another drawback resulting from the loose engagement between the cover ring 10'/outside nut 24 and the outside escutcheon is that the outside escutcheon tends to turn freely such that the outside escutcheon might be moved longitudinally away from the doorplate and thus has a gap therebetween. As a result, the lock can be damaged by a burglar by means of inserting a tool through the gap.

Applicant's U.S. patent application Ser. No. 09/576,332 filed on May 22, 2000, now U.S. Pat. No. 6,302,457 discloses a door lock that can be installed easily, wherein rotation of the outside rose causes longitudinal movement of the outside rose and the outside rose liner relative to the outside seat to suit a thickness of a door to which the door lock is mounted. The present invention is intended to provide an improved door lock in this regard for mitigating and/or obviating the above problems.

SUMMARY OF THE INVENTION

It is an object of the present invention to provide a door lock that can be installed easily.

It is another object of the present invention to provide a door lock for providing a burglarproof effect for the outside rose assembly.

A door lock in accordance with the present invention comprises:

a main body including a transmission assembly and a positioning assembly, the transmission assembly including an inside spindle, an outside spindle, a retractor, and a latch bolt, the positioning assembly including an inside seat and an outside seat, the outside seat including an outer threading;

an inside rose liner mounted around the inside seat;

an inside rose mounted around the inside rose liner;

an anti-torque ring mounted around the outside seat, the anti-torque ring including two positioning posts projecting therefrom and a hole;

an adjusting sleeve including an inner threading that is engaged with the outer threading of the outside seat, the adjusting sleeve including a first end and a second end, the first end of the adjusting sleeve including two diametrically opposed cutouts, thereby defining two sector wings each having two end faces, each said end face defining an end of an associated said cutout, the sector wings of the adjusting sleeve being mounted into the hole of the anti-torque ring with each said end face bearing against an associated said end of the associated flat section of the anti-torque ring;

an outside rose securely mounted around the second end of the adjusting sleeve to rotate move therewith;

an inside handle operably connected to the transmission assembly; and an outside handle operably connected to the transmission assembly;

whereby rotation of the outside rose causes longitudinal movement of the outside rose and the adjusting sleeve relative to the outside seat to suit a thickness of a door to which the door lock is mounted.

The inside seat includes an outer threading and the inside rose liner includes a threaded inner periphery for engaging with the outer threading of the inside seat. The inside rose liner includes an outer periphery having at least one notch such that a locksmith or user may insert a tool into the notch to turn the inside loser liner. The outer periphery of the inside rose liner and the threaded inner periphery of the inside rose liner together define an intermediate portion therebetween in which a plurality of pairs of diametrically opposed positioning holes is defined. Two screws are extended through two of the positioning holes of the inside rose liner and the two positioning posts of the anti-torque ring.

The outside rose includes a central stepped portion with a central through-hole, and the central stepped portion fittingly receives the second end of the adjusting sleeve to rotate therewith. The outside seat includes an outer threading having two diametrically disposed flat surfaces. An inner periphery that defines the hole of the anti-torque ring includes two diametrically disposed flat sections. The anti-torque ring is mounted around the outside seat with the flat sections of the anti-torque ring engaged with the flat surfaces of the outside seat.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
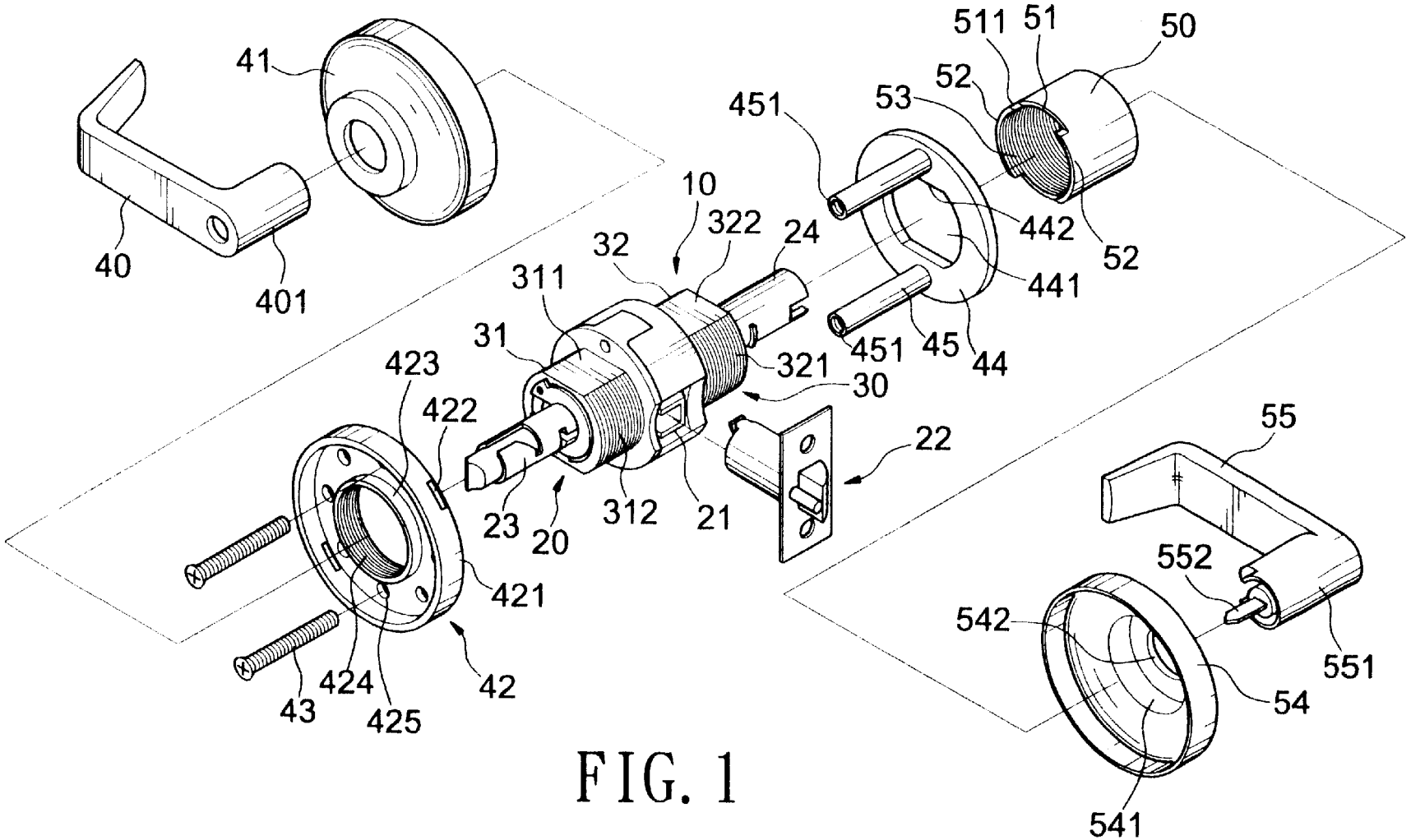
FIG. 1 is an exploded perspective view of a door lock in accordance with the present invention.
Figure 2:
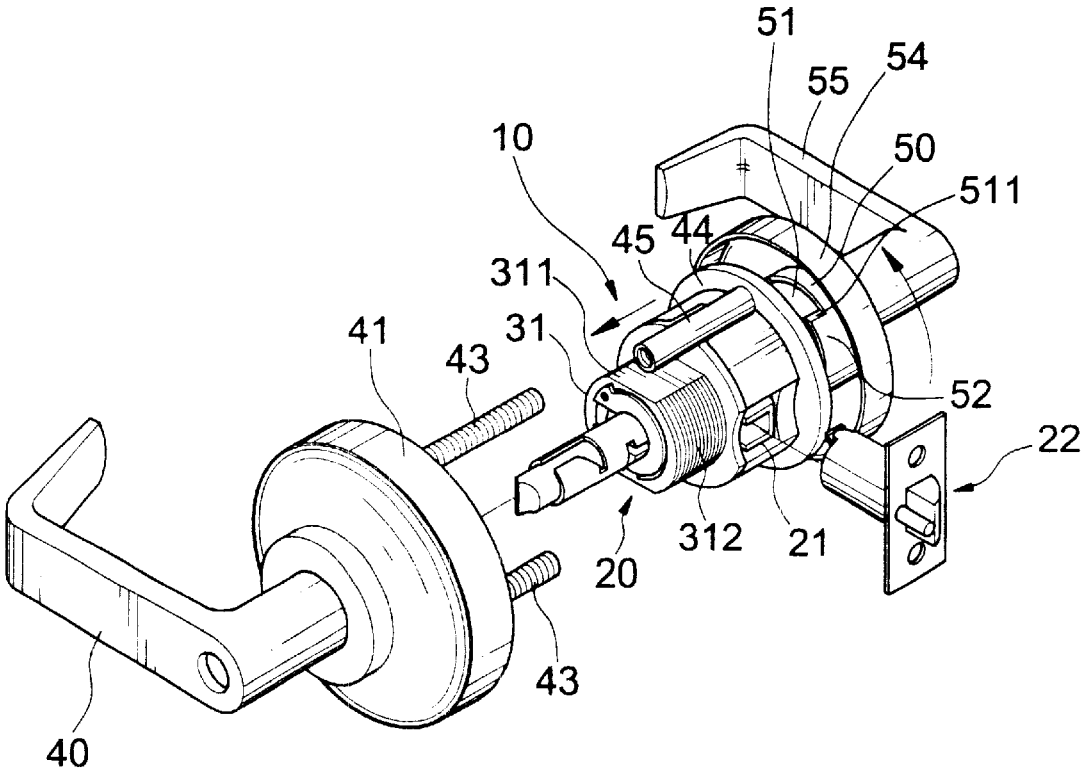
FIG. 2 is an exploded perspective view of the door lock in accordance with the present invention, wherein most of the parts of the door lock have been assembled.
Figure 3:
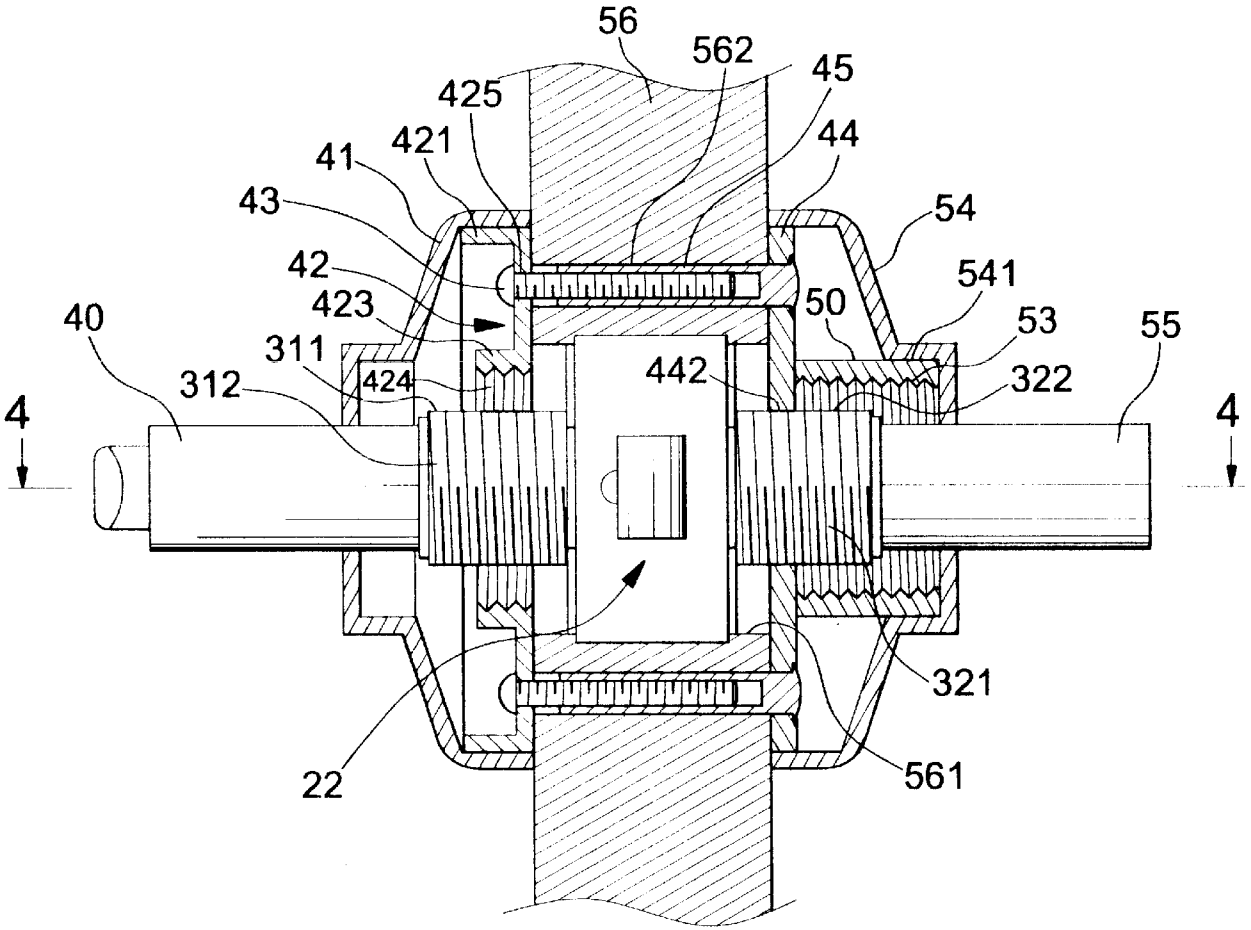
FIG. 3 is a sectional view of the door lock in accordance with the present invention mounted to a thin door.
Figure 4:
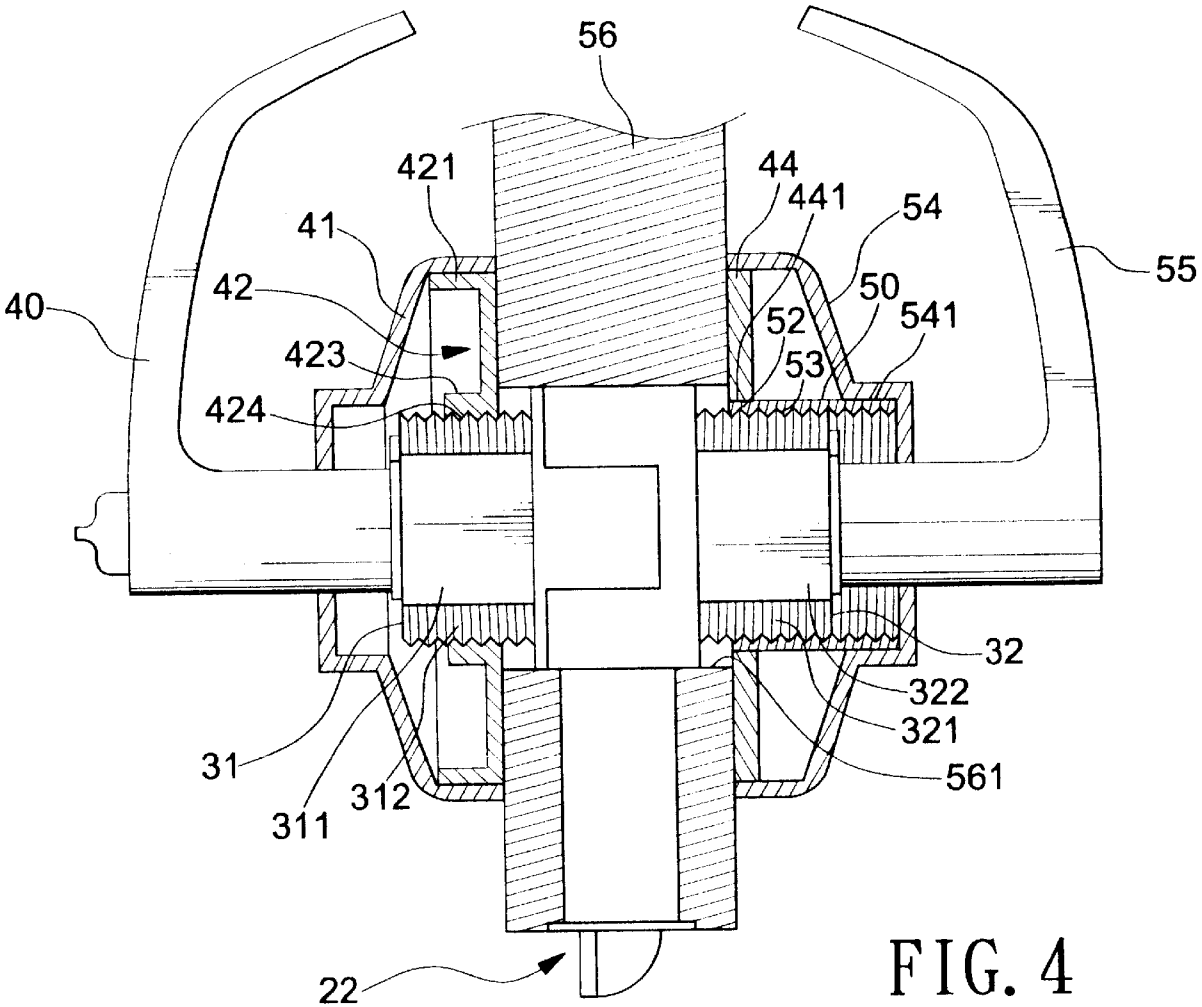
FIG. 4 is a sectional view taken along line 4—4 in FIG. 3.

Referring to FIGS. 1 and 2, a door lock in accordance with the present invention generally includes a main body 10, an inside rose liner 42, an anti-torque ring 44, an inside rose 41, an adjusting sleeve 50, an outside rose 54, an inner handle 40 (e.g., a lever handle), and an outside handle 55 (e.g., a lever handle). The main body 10 includes a transmission assembly 20 and a positioning assembly 30. The transmission assembly 20 includes an inside spindle 23, an outside spindle 24, a retractor 21, and a latch bolt 22. The positioning assembly 30 includes an inside seat 31 and an outside seat 32. The inside seat 31 includes an outer threading 312 having two diametrically disposed flat surfaces 311. The outside seat 32 includes an outer threading 321 having diametrically disposed flat surfaces 322.

The inside rose liner 42 includes a threaded inner periphery 424 defined by an inner flange 423 and an outer periphery 421 defined by an outer flange 421. An annular intermediate section (not labeled) between the inner flange 423 and the outer flange 421 includes a plurality of pairs of positioning holes 425 through which two screws 43 extend. The inside rose liner 42 is mounted around the inside seat 31 with the threaded inner periphery 424 engaged with the outer threading 312 of the inside seat 31.

The anti-torque ring 44 includes two positioning posts 45 extended outward therefrom and two diametrically disposed flat sections 442 in an inner periphery defining a hole 441 thereof. The anti-torque ring 44 is mounted around the outside seat 32 with the flat sections 442 being in contact with the flat surfaces 322 of the outside seat 32. In addition, a screw hole 451 in each positioning post 45 is aligned with an associated positioning hole 425 in the inside rose liner 42. The screws 43 are extended through two of the positioning holes 425 of the inside rose liner 42 and the screw holes 451 in the positioning posts 45.

The adjusting sleeve 50 includes an inner threading 53 so as to be engaged with the outer threading 321 of the outside seat 32. The adjusting sleeve 50 includes two diametrically opposed cutout 51 in an end thereof, thereby forming two sector wings 52 each having two end faces 511, each end face 511 defining an end of an associated cutout 51. The sector wings 52 of the adjusting sleeve 50 are inserted into the hole 441 of the anti-torque ring 44 with each end face 511 bearing against an associated end of the associated flat section 441. The outside rose 54 includes a central stepped portion 541 with a central through-hole 542. The central stepped portion 541 fittingly receives the other end of the adjusting sleeve 50 to rotate therewith.

The outside handle 55 includes an end 551 that is extended through the outside rose 54. A lock core 552 is mounted in the end 551 of the outside handle 55 and extended into the outside spindle 24. The inside handle 40 includes an end 401 that is extended through the inside rose 41. When either spindle 40 or 55 is turned, the retractor 21 is moved inward to retract the latch bolt 22 away from an opening (not shown) defined in a door frame (not shown), which is conventional and therefor not further described.

Referring to FIGS. 1 and 2, a lock core manufactured and assembled in a factory is a status in which the anti-torque ring 44 has been mounted around the outside seat 32 and the inner threading 53 of the adjusting ring 50 is engaged with the outer threading 321 of the outside seat 32. In addition, the end 551 of the outside handle 55 is inserted through the outside rose 54 and connected with the outside spindle 24 of the main body 10. Referring to FIGS. 1 through 4, when mounting the door lock of the present invention to a thin door 56, the anti-torque ring 44 is firstly disengaged from the adjusting ring 50. Then, the outside rose 54 is turned, the adjusting sleeve 50 securely mounted in the outside rose 54 is also turned. By means of turning the outside rose 54, the adjusting sleeve 50 and the outside rose 54 move longitudinally relative to the outside seat 32 due to threading engagement 321 and 53. Thus, position of the adjusting sleeve 50 and the outside rose 54 can be adjusted to suit the thickness of the door 56. The main body 10 is then inserted into a hole 561 in the door 56. The positioning posts 45 of the anti-torque ring 44 are extended through positioning holes 562 in the door 56. The sector wings 52 of the positioned adjusting sleeve 50 are located in the hole 441 of the anti-torque ring 44. The retractor 21 is located in a center of the door thickness and thus faces the opening in the door frame. The inner rose liner 42 is then mounted to the inside seat 31 and the screws 43 are extended through the positioning holes 425 in the inside rose liner 42 and the screw holes 451 in the positioning posts 45. Next, the inside rose 41 and the inside handle 40 are mounted to finish the assembly procedure.

Figure 5:
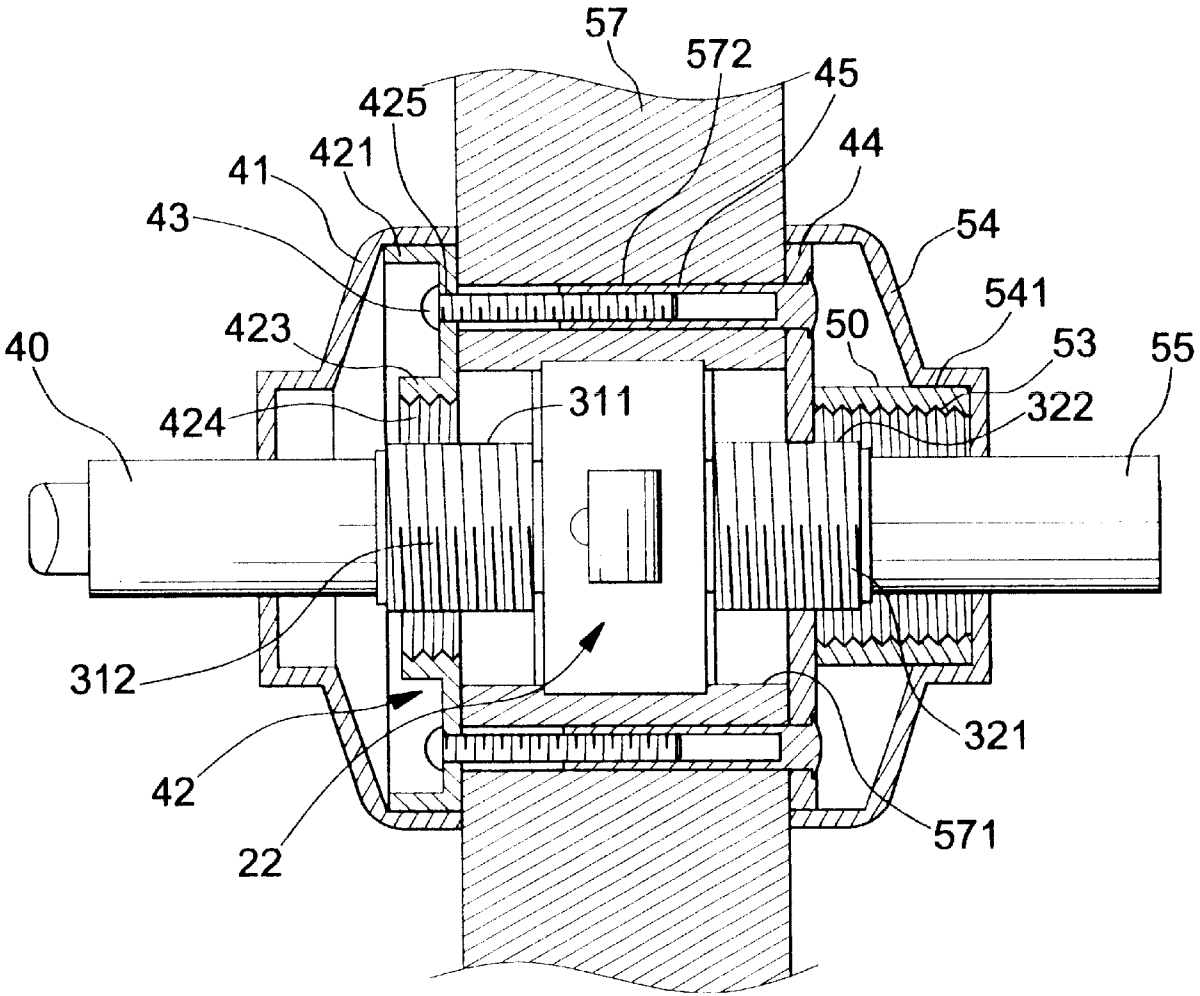
FIG. 5 is a sectional view similar to FIG. 3, wherein the door lock is mounted to a thick door.

FIG. 5 shows mounting of the door lock of the present invention to a thick door 57. The installation procedure is identical to that for a thin door 56. Thus, when mounting the door lock to a door, the locksmith or the user may simply rotate the outside rose 50 to adjust the position of the outside rose 54 and the adjusting sleeve 50 to suit the door thickness. The outside rose 54 and the outside handle 55 need not to be detached, which is quite convenient. The outer end of the adjusting sleeve 50 is shielded by the stepped portion 541 of the outside rose 54 such that finish plating is not required. The threaded inner periphery 424 of the inside rose liner 42 is threadedly engaged with the outer threading 311 of the inside seat 31. In addition, a plurality of notches 422 is defined in the outer periphery 421 of the inside rose liner 42 such that the locksmith or user may insert a tool into the notch 422 to turn and thus move the inside rose liner 42 relative to the inside seat 31, thereby moving the inside rose liner 42 to a place where the inside rose liner 42 is positioned.

Although the invention has been explained in relation to its preferred embodiment, it is to be understood that many other possible modifications and variations can be made without departing from the spirit and scope of the invention as hereinafter claimed.

What is claimed is:

1. A door lock comprising:

a main body including a transmission assembly and a positioning assembly, the transmission assembly including an inside spindle, an outside spindle, a retractor, and a latch bolt, the positioning assembly including an inside seat and an outside seat, the outside seat including an outer threading;

an inside rose liner mounted around the inside seat;

an inside rose mounted around the inside rose liner;

an anti-torque ring mounted around the outside seat, the anti-torque ring including two positioning posts projecting therefrom and a hole;

an adjusting sleeve including an inner threading that is engaged with the outer threading of the outside seat, the adjusting sleeve including a first end and a second end, the first end of the adjusting sleeve including two diametrically opposed cutouts, thereby defining two sector wings each having two end faces, each said end face defining an end of an associated said cutout, the sector wings of the adjusting sleeve being mounted into the hole of the anti-torque ring with each said end face bearing against an associated said end of the associated flat section of the anti-torque ring;

an outside rose securely mounted around the second end of the adjusting sleeve to rotate move therewith;

an inside handle operably connected to the transmission assembly; and an outside handle operably connected to the transmission assembly;

whereby rotation of the outside rose causes longitudinal movement of the outside rose and the adjusting sleeve relative to the outside seat to suit a thickness of a door to which the door lock is mounted.

2. The door lock as claimed in claim 1, wherein the inside seat includes an outer threading, the inside rose liner including a threaded inner periphery for engaging with the outer threading of the inside seat.

3. The door lock as claimed in claim 2, wherein the inside rose liner includes an outer periphery having at least one notch.

4. The door lock as claimed in claim 3, wherein the outer periphery of the inside rose liner and the threaded inner periphery of the inside rose liner together define an intermediate portion therebetween in which a plurality of pairs of diametrically opposed positioning holes is defined, and wherein two screws are extended through two of the positioning holes of the inside rose liner and the two positioning posts of the anti-torque ring.

5. The door lock as claimed in claim 1, wherein the outside rose includes a central stepped portion with a central through-hole, and wherein the central stepped portion fittingly receives the second end of the adjusting sleeve to rotate therewith.

6. The door lock as claimed in claim 1, wherein the outside seat includes an outer threading having two diametrically disposed flat surfaces, an inner periphery that defines the hole of the anti-torque ring including two diametrically disposed flat sections, the anti-torque ring being mounted around the outside seat with the flat sections of the anti-torque ring engaged with the flat surfaces of the outside seat.

* * * * *